US005562434A

United States Patent [19]

Makino et al.

[11] Patent Number: 5,562,434

[45] Date of Patent: Oct. 8, 1996

[54] SCROLL COMPRESSOR HAVING OPTIMIZED TIP SEAL GROOVES

[75] Inventors: Masahiko Makino, Yawata; Michio Yamamura; Masafumi Fukushima, both of Kusatsu; Kunio Iwanami, Moriyama, all of Japan

[73] Assignee: Matsushita Electric Industrial Co., Ltd., Osaka-fu, Japan

[21] Appl. No.: 449,714

[22] Filed: May 24, 1995

[30] Foreign Application Priority Data

Apr. 17, 1995 [JP] Japan ..... 7-090701

[51] Int. Cl.[6] ..... F04C 18/04; F04C 27/00

[52] U.S. Cl. ..... 418/55.2; 418/55.4; 418/142; 418/150

[58] Field of Search ..... 418/55.2, 55.4, 418/142, 150

[56] References Cited

U.S. PATENT DOCUMENTS 4,781,549 11/1988 Caillat ..... 418/55.2
4,869,658 9/1989 Tsutsumi et al. ..... 418/55.4

FOREIGN PATENT DOCUMENTS 4-54201 2/1992 Japan ..... 418/55.2
6-221278 8/1994 Japan ..... 418/55.4

*Primary Examiner*—John J. Vrablik
*Attorney, Agent, or Firm*—Wenderoth, Lind & Ponack

[57] ABSTRACT

A scroll compressor includes a stationary scroll and an orbiting scroll having respective wrap elements in engagement with each other. Each of the stationary and orbiting wrap elements has a tip seal groove defined therein and having opposing internal and external walls that are formed so as to represent two involute curves having different phases, respectively.

4 Claims, 5 Drawing Sheets

SCROLL COMPRESSOR HAVING OPTIMIZED TIP SEAL GROOVES

BACKGROUND OF THE INVENTION

1. Field of the Invention

The present invention relates generally to a scroll compressor having stationary and orbiting scrolls in engagement with each other and, more particularly, to tip seal grooves formed in spiral wrap elements of the stationary and orbiting scrolls.

2. Description of Related Art

Generally available scroll compressors comprise a stationary scroll and an orbiting scroll, both of which have respective wrap elements each having an internal wall and an external wall opposite to each other.

In almost all of the scroll compressors, the internal and external walls are shaped so as to represent two involute curves, both of which are based on an identical involute base circle, but have different phases and, hence, the wall thickness thereof is made constant from an inner end to an outer end of each of the wrap elements. The compressing action is achieved by circling one of the wrap elements relative to the other under the condition in which the two wrap elements are circumferentially shifted 180° one from the other with the side walls thereof held in partial contact with each other.

Each of the wrap elements has a tip seal accommodated in a groove defined therein on an axial outer end thereof. The tip seal is held in sliding contact with an end surface of the confronting wrap element to establish an axial seal. The tip seal groove has opposing internal and external walls that are formed so as to represent two involute curves having different phases, like each of the wrap elements.

The internal wall of one of the two wrap elements can be shaped to represent a curve developing from the center of a base circle so as to extend spirally outwardly therefrom, while the external wall of said one of the two wrap elements is shaped based on the shape of the internal wall. In this case, the other wrap element is shaped with envelope curves obtained as a result of circular translation of said one wrap element relative thereto. The scroll compressors of this type have the advantage of being capable of enlarging the volume of entrapment, if the cylinder bore is identical, by making the factor of development large the factor of development being normally referred to as the constant (a) in the equations $f_1(\phi)=a\phi$, and $f_0(\phi)=a\phi+b$, compared with those of the aforementioned type having the wrap elements so shaped as to represent the involute curves. If the intake volume is identical, the outer diameter of a shell can be reduced, contributing to the compactness of the whole compressor as to the compressor being lightweight.

However, in the scroll compressors having the wrap elements so shaped as to represent such curves, if the internal and external walls of the tip seal groove are shaped so as to represent the same curves as those of the wrap elements, the groove width gradually increases in a direction towards the end of winding i.e., the outer end of the tip seal groove. Because the tip seal is of an identical cross section over the length thereof, the clearance between the tip seal, which is usually held in contact with the internal wall of the tip seal groove, and the external wall of the tip seal groove varies in a direction longitudinally thereof, thus causing a problem associated with sealing properties.

Also, in machining the tip seal groove, although a groove having an identical width can be formed through a single end milling operation, at least two milling operations are required for that having a varying width. In addition, the groove having a varying width is extremely inferior in processability to that having an identical width.

SUMMARY OF THE INVENTION

The present invention has been developed to overcome the above-described disadvantages.

It is accordingly an objective of the present invention to provide a scroll compressor having stationary and orbiting scrolls with tip seal grooves of an improved shape to enhance the reliability of the compressor.

Another objective of the present invention is to provide the scroll compressor of the above-described type of which the tip seal grooves are readily processable.

In accomplishing the above and other objectives, the scroll compressor of the present invention includes first and second wrap elements in engagement with each other, wherein an internal wall of the first wrap element has a principal portion that extends spirally outwardly from an inner end portion thereof and is shaped so as to represent a curve given by $r=a\phi$ on a polar coordinate $(r,\phi)$, while an external wall of the first wrap element has a principal portion that extends spirally outwardly from an inner end portion thereof and is shaped so as to represent a curve given by $r=a\phi+b$, each of said (a) and (b) being a constant. The internal wall of the second wrap element has a principal portion that extends spirally outwardly from the inner end portion thereof and is shaped with an envelope curve obtained as a result of circular translation of the external wall of the first wrap element relative to the second wrap element. Likewise, the external wall of the second wrap element has a principal portion that extends spirally outwardly from the inner end portion thereof and is shaped with an envelope curve obtained as a result of circular translation of the internal wall of the first wrap element relative to the second wrap element.

Each of the first and second wrap elements has a tip seal groove defined therein, said tip seal groove having opposing internal and external walls that are formed so as to represent two involute curves having different phases, respectively.

Advantageously, the constant (a) is substantially equal to the radius of a base circle of the two involute curves. Also, the distance between the internal wall of the tip seal groove and the internal wall of an associated wrap element is substantially equal to that between the external wall of the tip seal groove and the external wall of the associated wrap element at the inner end portion of the associated wrap element.

Preferably, the tip seal groove has an inner end portion wider than any other portions thereof. This configuration can restrict a tip seal received in the tip seal groove from moving along the tip seal groove.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
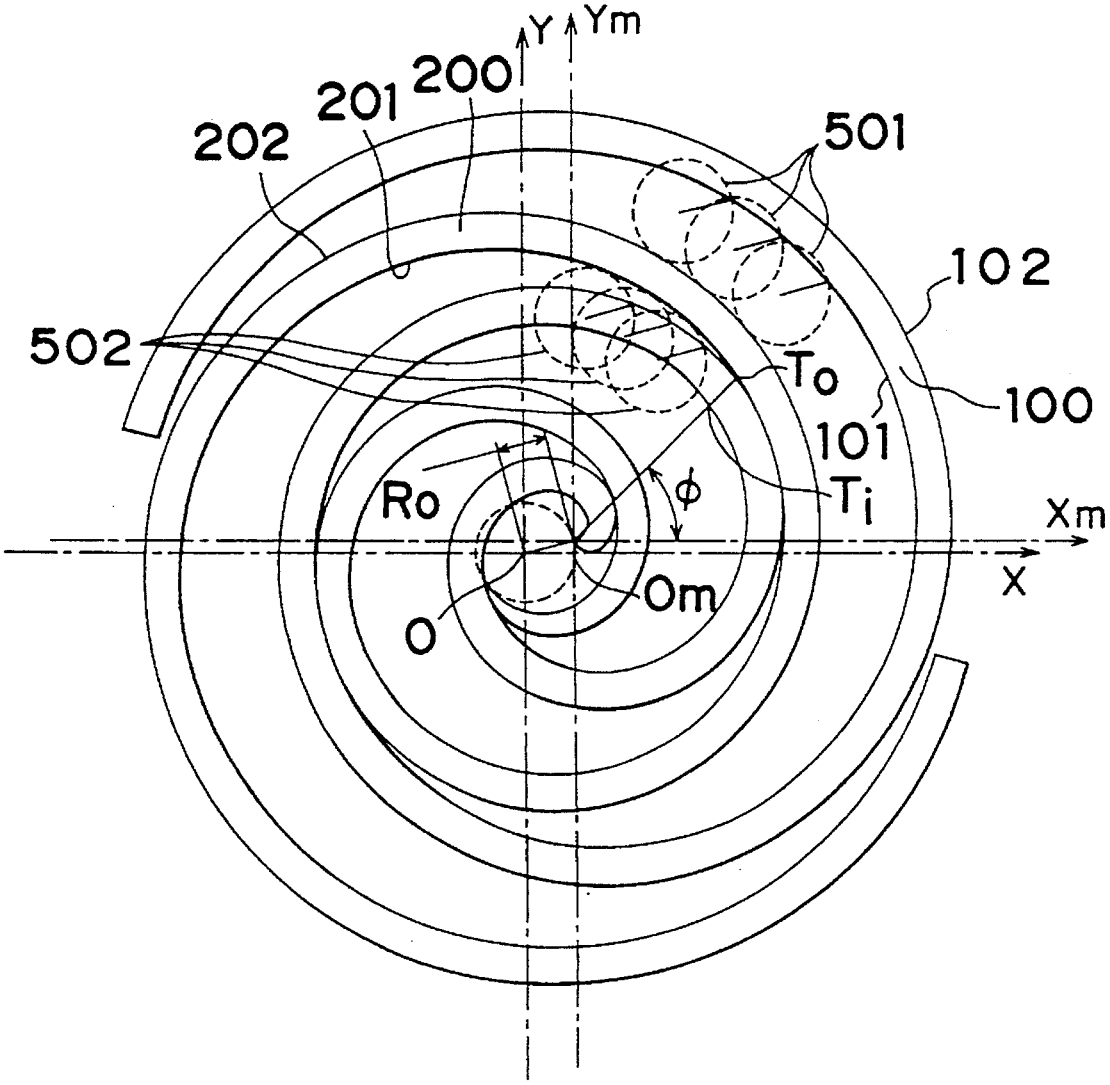
FIG. 1 is a schematic view of stationary and orbiting wrap elements in engagement with each other, to which tip seal grooves according to the present invention are applied.

Referring now to the drawings, there are shown in FIG. 1 a stationary wrap element 200 and an orbiting wrap element 100 in engagement with each other. The stationary wrap element 200 has an inner end portion and a principal portion extending spirally outwardly therefrom, while the orbiting wrap element 100 similarly has an inner end portion and a principal portion extending spirally outwardly therefrom.

In FIG. 1, relative coordinates (Xm, Ym) of the orbiting wrap element 100 undergo circular translation with a radius $R_0$ about the origin 0 of coordinates (X, Y) of the stationary wrap element 200. The distances from the origin Om to arbitrary points Ti and To of the internal and external walls 101 and 102 of the orbiting wrap element 100 are given respectively by:

$$OmTi=fi(\phi)=a\phi(a>0)$$

$$OmTo=fo(\phi)=a\phi+b(b>0)$$

where $\phi$ denotes the winding angle from the Xm-axis and is positive in the anticlockwise direction.

On the other hand, the internal wall 201 of the stationary wrap element 200 is shaped with an envelope curve of locus circles of a radius $R_0$ which points on the external wall 102 of the orbiting wrap element 100 draw, while the external wall 202 of the stationary wrap element 200 is shaped with an envelope curve of locus circles of a radius $R_0$ which points on the internal wall of the orbiting wrap element 100 draw. The coordinates (X, Y) of arbitrary points Pi and Po on the internal and external walls 201 and 202 of the stationary wrap element 200 are given respectively by:

$$xi=fo(\phi)\cdot\cos\phi+Ro\cdot\cos(\phi-\alpha_o)$$

$$Yi=fo(\phi)\cdot\sin\phi+Ro\cdot\sin(\phi-\alpha_o)$$

$$Xo=fi(\phi)\cdot\cos\phi-Ro\cdot\cos(\phi-\alpha_i)$$

$$Yo=fi(\phi)\cdot\sin\phi-Ro\cdot\sin(\phi-\alpha_i)$$

where $$\alpha_i=\tan^{-1}\{fi'(\phi)/fi(\phi)\}$$

$$\alpha_0=\tan^{-1}\{fo'(\phi)/fo(\phi)\}$$

Figure 2:
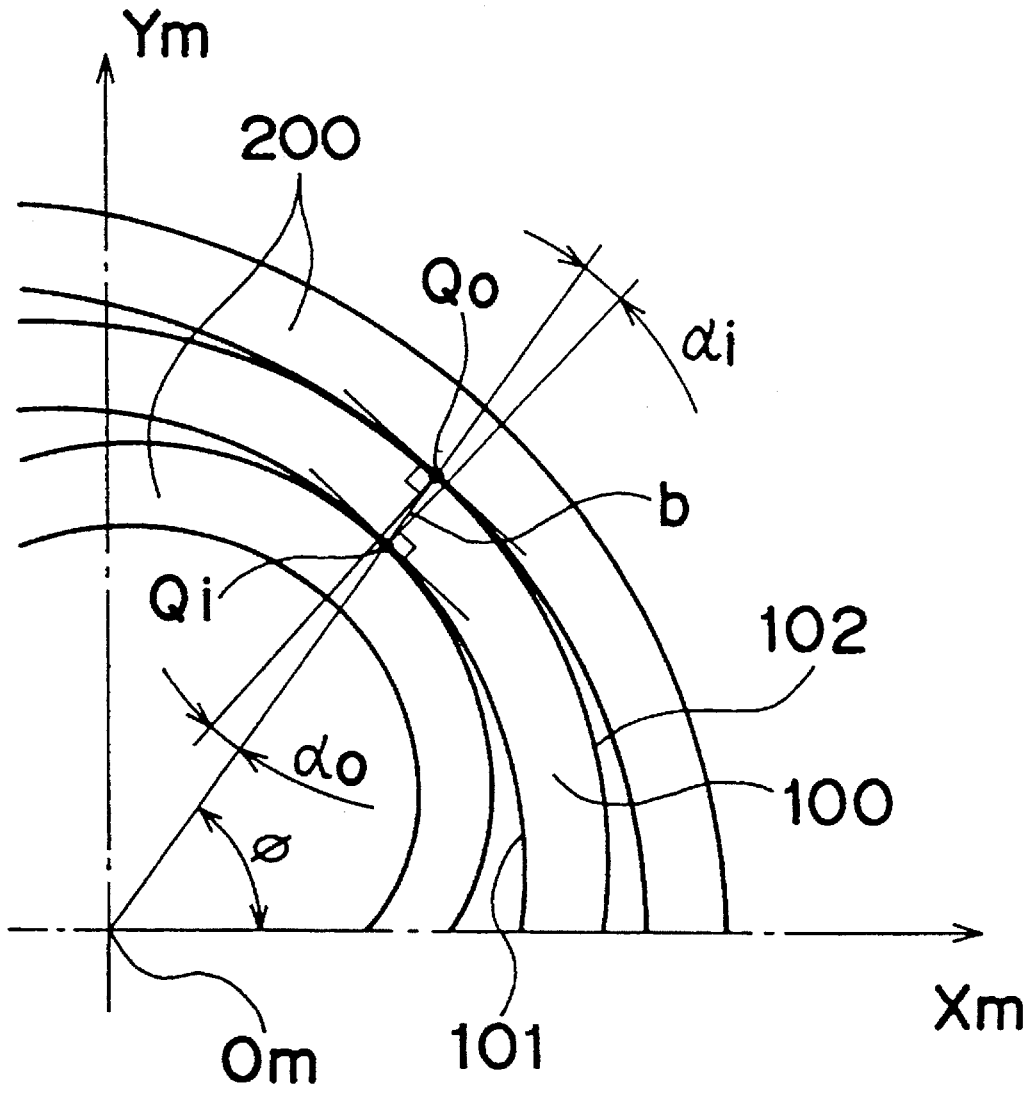
FIG. 2 is an enlarged partial schematic view of the stationary and orbiting wrap elements of FIG. 1, particularly indicating the condition in which a portion of a convolution of the stationary wrap element is shifted radially outwardly to come into contact with that convolution of the orbiting wrap element which is positioned outwardly thereof.

FIG. 2 depicts the condition in which a portion of a convolution of the stationary wrap element 200 is shifted radially outwardly to come into contact with that convolution of the orbiting wrap element 100 which is positioned outwardly thereof. As shown therein, $\alpha_i$ is an angle formed between a straight line connecting the origin Om with a point Qo lying on the external wall curve 102 and the normal to the external wall curve 102 at the point Qo, while $\alpha_o$ is an angle formed between a straight line connecting the origin Om with a point Qi lying on the internal wall curve 101 and the normal to the internal wall curve 101 at the point Qi.

Accordingly, the shortest distance (wall thickness) $t_Q$ from the point Qi to the external wall curve is given by:

$$t_Q=b\cdot\cos(\alpha_i)$$

and, hence, when $\phi\rightarrow\infty$, $\cos(\alpha_i)\rightarrow 1$, and when $\phi\rightarrow 0$, $\cos(\alpha_i)\rightarrow 0$.

From the above, it can be readily known that the wall thickness of the orbiting wrap element 100 gradually decreases from the outer end to the inner end thereof. The same is true for the stationary wrap element 200.

Figure 3:
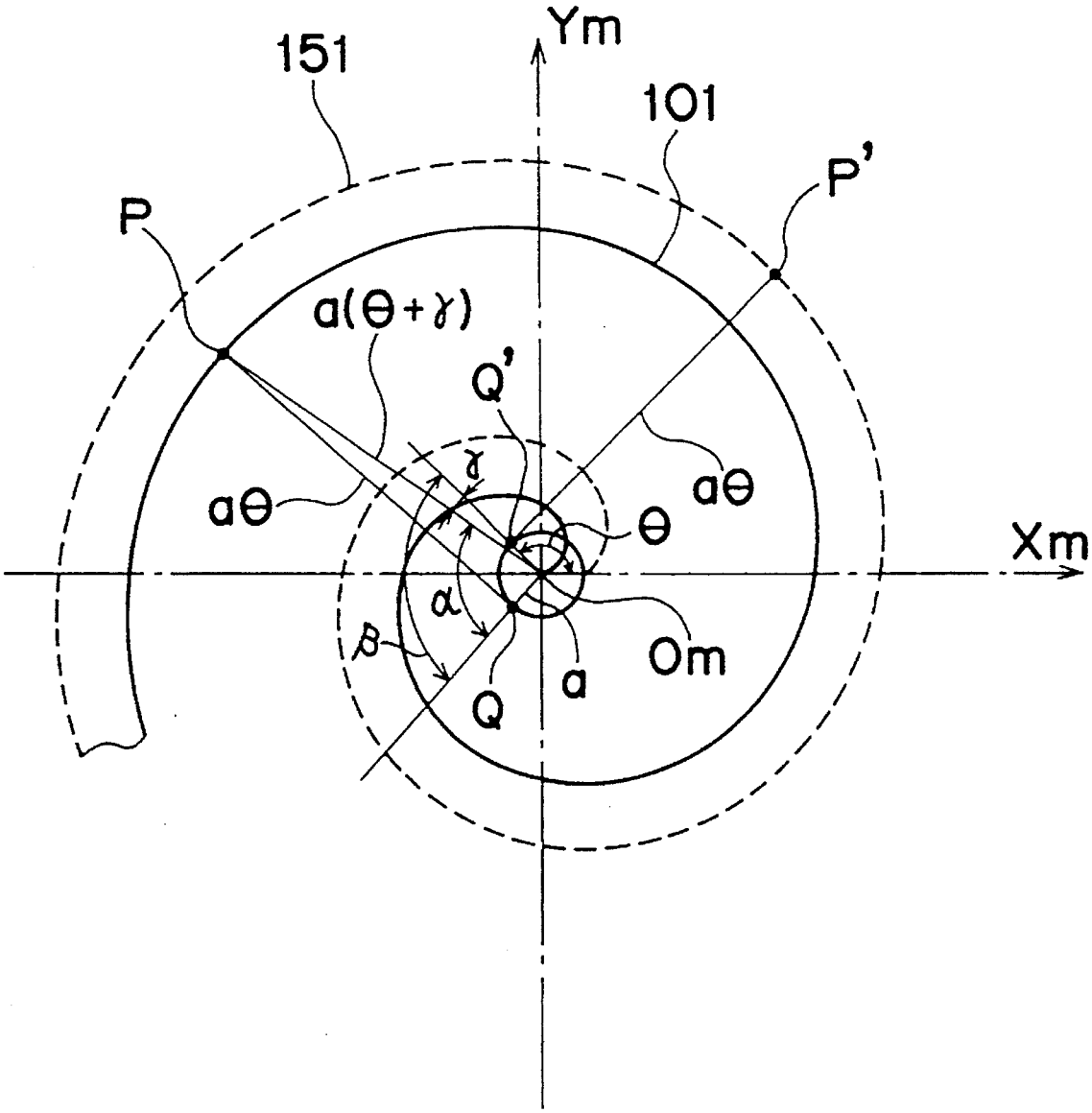
FIG. 3 is a diagram indicating a relationship between an internal wall curve of the orbiting wrap element and an involute curve.

FIG. 3 depicts a relationship between the internal wall curve 101 of the orbiting wrap element 100 and an involute curve 151. It is assumed here that the radius (s=OmQ') of a base circle of the involute curve is equal to the factor (a) above (s=a). An arbitrary point P' on the curve 151, which is determined by an angle$\theta$, can be positioned on the point P on the curve 101 by rotating the former counterclock-wise about the origin Om by an angle$\beta$.

$$P'Q'=PQ=a\theta$$

Because a triangle OmPQ is a right triangle, $$a^2+(a\theta)^2=a^2(\theta+\gamma)^2.$$

Accordingly, $$\gamma=(1+\theta^2)^{1/2}-\theta \quad (1)$$

Furthermore, $$\alpha=\tan^{-1}(a\theta/a)=\tan^{-1}\theta \quad (2)$$

$$\beta=\alpha+\gamma \quad (3)$$

From (1), (2), and (3), $$\beta=(1+\theta^2)^{1/2}-\theta+\tan^{-1}\theta$$

Figure 4:
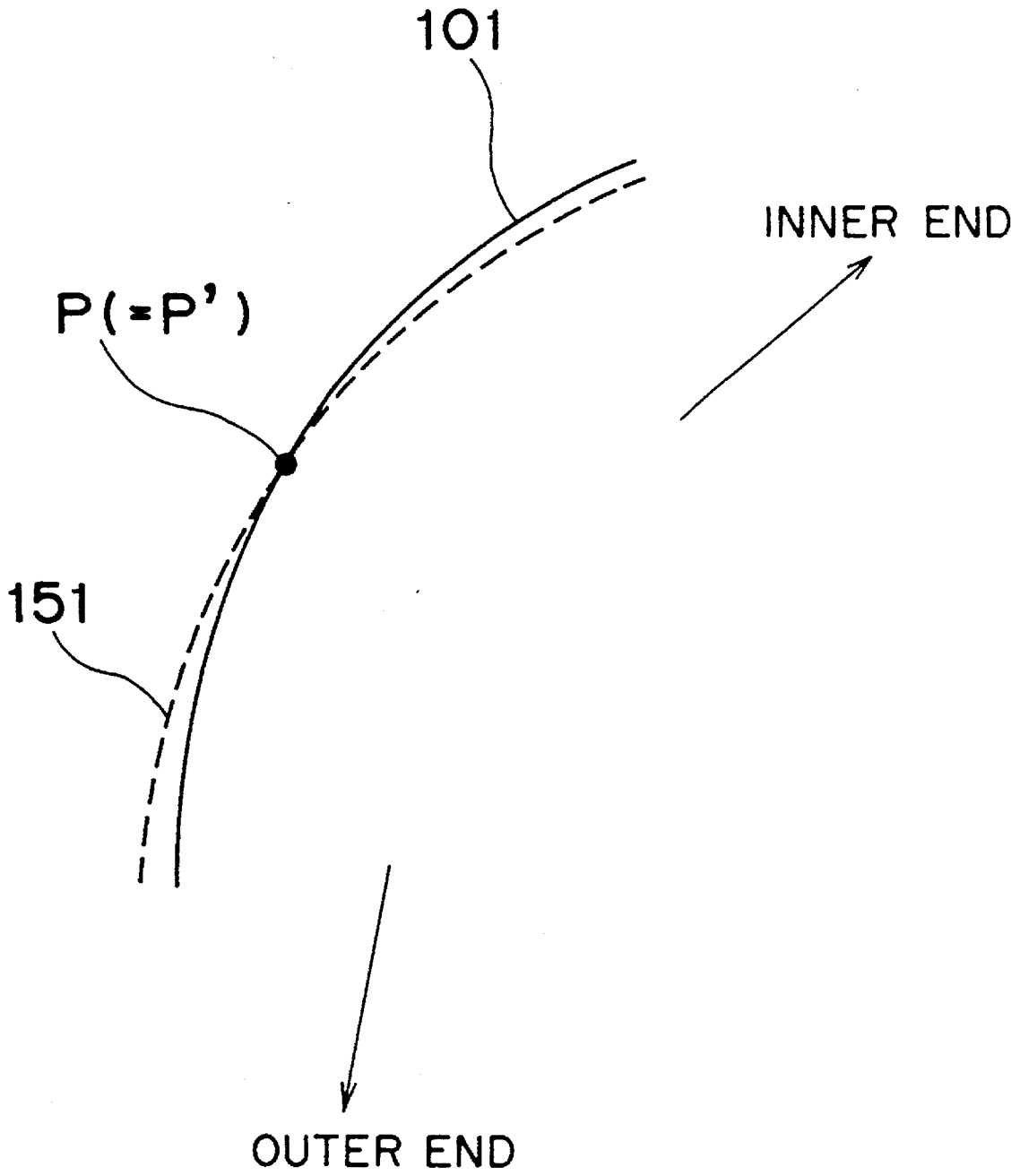
FIG. 4 is a diagram indicating the relationship between the internal wall curve of the orbiting wrap element and the involute curve, both shown in FIG. 3, after rotation of the involute curve by a given angle.

When the point P' is positioned on the point P in the above-described manner, the curve 101 and the curve 151 slightly deviate from each other before and after the point P or P', as clearly shown in FIG. 4. The curve 151 is positioned inwardly of the curve 101 in the direction towards the start of winding (the inner end of the wrap element), whereas the curve 101 is positioned inwardly of the curve 151 in the direction towards the end of winding (the outer end of the wrap element). Because the angle$\theta$ depends upon the angle$\beta$, an appropriate selection of the former results in optimization of the latter. Accordingly, upon rotation of the curve 151 by a given angle, a curve indicative of an internal or external wall of a tip seal groove can be obtained by offsetting the curve 151 in a direction widthwise of the tip seal groove. In this case, because of the aforementioned deviation between the two curves 101 and 151, the thickness of each of the internal and external walls of the tip seal groove varies in a direction longitudinally thereof.

Figure 5:
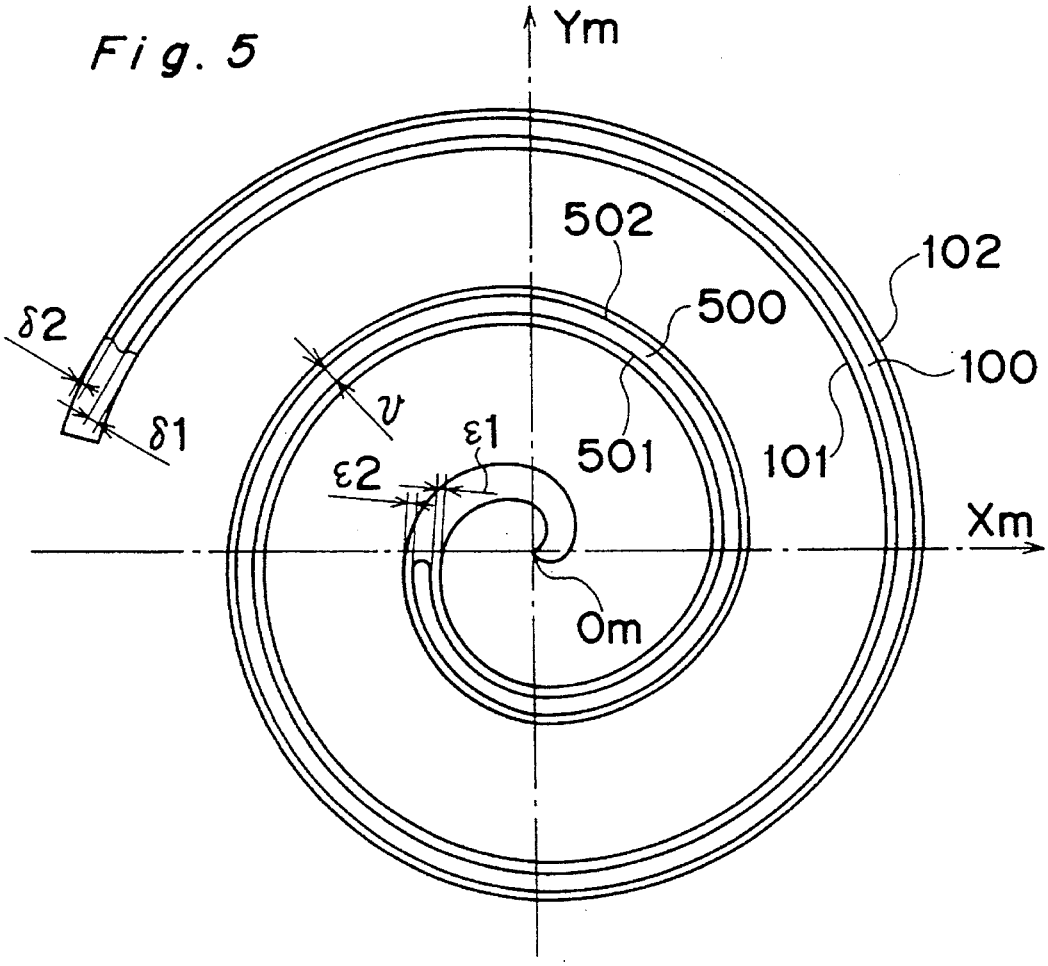
FIG. 5 is an end view of the orbiting wrap element in which the chip seal groove according to the present invention is formed.

FIG. 5 depicts a tip seal groove 500 formed in the above-described manner where (a) and (b) are so chosen as to be a=s=3.2 and b=4.2. In FIG. 5, an external wall 502 of the tip seal groove 500 is formed so as to represent a curve that is obtained by rotating an involute curve by θ=30°, while an internal wall 501 of the tip seal groove 500 is formed so as to represent a curve that is obtained by rotating an involute curve by θ=35.8°(and, hence, the groove width is u=2.0). Two opposite ends of the tip seal groove 500 are rounded at locations spaced certain distances away from the inner and outer ends of the orbiting wrap element 100, respectively.

At the outer end of the tip seal groove 500, when the distance between the internal wall 501 of the tip seal groove 500 and the internal wall 101 of the orbiting wrap element 100 is represented by δ1 and that between the external wall 502 of the chip seal groove 500 and the external wall 102 of the orbiting wrap element 100 is represented by δ2, the following relationship is established:

$$\delta 1(=1.21)>\delta 2(=0.93).$$

On the other hand, at the inner end of the tip seal groove 500, when the distance between the internal wall 501 of the tip seal groove 500 and the internal wall 101 of the orbiting wrap element 100 is represented by ε1 and that between the external wall 502 of the tip seal groove 500 and the external wall 102 of the orbiting wrap element 100 is represented by ε2, the following relationship is established:

$$\epsilon 1(=0.84)<\epsilon 2(=1.18)$$

As described above, an optimized seal groove can be formed between the internal and external walls 101 and 102 of the orbiting wrap element 100 by appropriately selecting the angle θ.

It is preferred that ε1 and ε2 are so chosen as to be substantially equal to each other to make them as large as possible. The reason for this is that the pressure of entrapped gas becomes high at the inner end of the orbiting wrap element 100, and the side walls become thin as discussed above.

Although in the above-described embodiment description has been made with respect to the orbiting wrap element 100, the same is true for the stationary wrap element 200.

Furthermore, although in the above-described embodiment constants (a) and (b) are caused to be equal to 3.2 and 4.2, respectively, the former is not limited by the latter but may differ therefrom. It is however preferred that the constant (a) is substantially equal to the radius (s) of the base circle of the involute curve.

Figure 6:
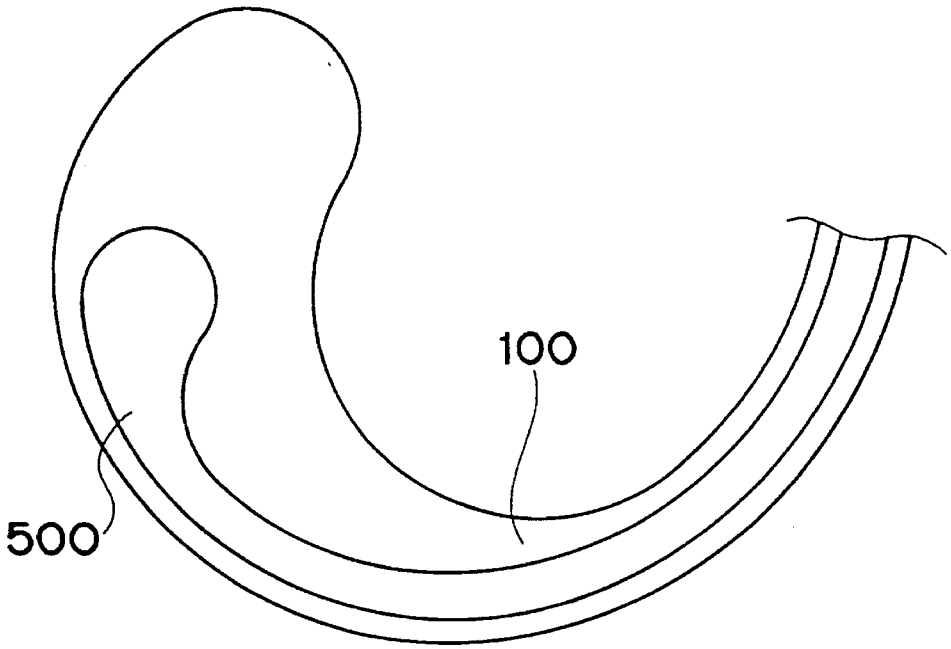
FIG. 6 is an enlarged end view of an inner end portion of the orbiting wrap element according to a modification of the present invention.

FIG. 6 depicts a modification of the inner end portion of the tip seal groove 500. According to this modification, the inner end portion of the tip seal groove 500 is made wider than any other portions of the tip seal groove 500. This configuration is particularly effective in restricting movement of the tip seal along the tip seal groove 500, thus providing a desired invariable sealing condition.

As is clear from the above, not only the reliability of the scroll compressor but also the processability of the tip seal groove can be enhanced by appropriately selecting the shape of the tip seal groove.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. In a scroll compressor having first and second wrap elements in engagement with each other, each of said first and second wrap elements having an internal wall and an external wall opposite to each other and also having an inner end portion and an outer end portion opposite to each other, wherein the improvement comprises:

the internal wall of said first wrap element having a principal portion that extends spirally outwardly from the inner end portion thereof and is shaped with a curve given by $r=a\phi$ on a polar coordinate (r, ø), said (a) being a constant;

the external wall of said first wrap element having a principal portion that extends spirally outwardly from the inner end portion thereof and is shaped with a curve given by $r=a\phi+b$, said (b) being a constant;

the internal wall of said second wrap element having a principal portion that extends spirally outwardly from the inner end portion thereof and is shaped with an envelope curve obtained as a result of circular translation of the external wall of said first wrap element relative to said second wrap element;

the external wall of said second wrap element having a principal portion that extends spirally outwardly from the inner end portion thereof and is shaped with an envelope curve obtained as a result of circular translation of the internal wall of said first wrap element relative to said second wrap element; and each of said first and second wrap elements having a tip seal groove defined therein, said tip seal groove having opposing internal and external walls that are formed so as to represent two involute curves having different phases, respectively.

2. The scroll compressor according to claim 1, wherein said constant (a) is substantially equal to a radius of a base circle of said two involute curves.

3. The scroll compressor according to claim 1, wherein a distance between the internal wall of said tip seal groove and the internal wall of an associated wrap element is substantially equal to a distance between the external wall of said tip seal groove and the external wall of said associated wrap element at the inner end portion of said associated wrap element.

4. The scroll compressor according to claim 1, wherein said tip seal groove has an inner end portion wider than any other portions of said tip seal groove.

* * * * *